US007344460B2

(12) United States Patent
Gait

(10) Patent No.: US 7,344,460 B2
(45) **Date of Patent: *Mar. 18, 2008**

(54) LACROSSE HEAD WITH CUSHIONED SIDEWALLS

(75) Inventor: Paul Gait, Albany, NY (US)

(73) Assignee: Rawlings Sporting Goods Company, Inc., St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/555,635

(22) Filed: Nov. 1, 2006

(65) Prior Publication Data

US 2007/0060424 A1 Mar. 15, 2007

Related U.S. Application Data

(63) Continuation of application No. 11/021,256, filed on Dec. 22, 2004, now Pat. No. 7,214,151.

(51) Int. Cl.
*A63B 59/02* (2006.01)
*A63B 65/12* (2006.01)

(52) U.S. Cl. ..... 473/513; D21/724

(58) Field of Classification Search ..... 473/512, 473/513, 505; D21/724

See application file for complete search history.

(56) References Cited

U.S. PATENT DOCUMENTS

| | | | | |
|---|---|---|---|---|
| 3,507,495 A | | 4/1970 | Tucker et al. | |
| 3,992,008 A | * | 11/1976 | Watkin | 473/513 |
| 4,034,984 A | * | 7/1977 | Crawford et al. | 473/513 |
| 4,037,841 A | | 7/1977 | Lewis, Jr. | |
| 4,097,046 A | * | 6/1978 | Friant | 473/513 |
| 4,270,756 A | | 6/1981 | Ahlenfeld et al. | |
| 4,772,021 A | * | 9/1988 | Maynard | 473/521 |
| 4,880,234 A | * | 11/1989 | Salisbury | 473/457 |
| 5,413,335 A | * | 5/1995 | Braun | 473/521 |
| 5,568,925 A | | 10/1996 | Morrow et al. | |
| 5,651,549 A | | 7/1997 | Dill et al. | |
| 5,935,026 A | | 8/1999 | Dill et al. | |
| 6,500,079 B1 | | 12/2002 | Tucker, Sr. | |
| 6,561,932 B2 | | 5/2003 | Morrow et al. | |
| 6,723,134 B2 | * | 4/2004 | Tucker, Sr. | 473/513 |
| 6,929,572 B2 | * | 8/2005 | Morrow et al. | 473/513 |
| 7,044,868 B2 | * | 5/2006 | Brine et al. | 473/513 |
| 7,214,151 B1 | * | 5/2007 | Gait | 473/513 |

FOREIGN PATENT DOCUMENTS

| | | |
|---|---|---|
| CA | 342045 | 6/1934 |

* cited by examiner

*Primary Examiner*—Eugene Kim
*Assistant Examiner*—M. Chambers
(74) *Attorney, Agent, or Firm*—Waddey & Patterson, P.C.; Phillip E. Walker

(57) ABSTRACT

A lacrosse head comprising a frame, a pocket attached to the frame, and at least one energy absorbing element engaging the frame to absorb energy from an impact to the pocket. Preferably, the frame, which includes a scoop, a throat, and sidewalls, includes energy absorbing elements positioned proximate to the throat and along the sidewalls of the frame. The energy absorbing elements can be positioned on an external surface of the perimeter of the frame. The frame includes pocket attachment apertures and the energy absorbing elements include apertures, wherein the apertures on the energy absorbing elements are substantially aligned with the pocket attachment apertures to secure the energy absorbing elements to the frame.

14 Claims, 10 Drawing Sheets

LACROSSE HEAD WITH CUSHIONED SIDEWALLS

This application is a continuation application of U.S. application Ser. No. 11/021256 filed Dec. 22, 2004 now U.S. Pat. No. 7,214,151 entitled "Lacrosse Head with Cushioned Sidewalls", which is hereby incorporated by reference in its entirety.

I, Paul Gait, a citizen of Canada, residing at 5 Burdick Drive , Albany, N.Y. 12205, have invented a new and useful "Lacrosse Head With Cushioned Side walls."

A portion of the disclosure of this patent document contains material that is subject to copyright protection. The copyright owner has no objection to the facsimile reproduction by anyone of the patent document or the patent disclosure, as it appears in the U.S. Patent and Trademark Office patent file or records, but otherwise reserves all copyright rights whatsoever.

All patent and publications described or discussed herein are hereby incorporated by reference in their entirety.

BACKGROUND OF THE INVENTION

It will be appreciated by those of ordinary skill in the art that lacrosse is a fast growing sport. It will further be appreciated that lacrosse heads are essential to playing the game. A lacrosse head is a collection, catching, or basket-type, element that attaches to the end of a handle, or lacrosse stick. The lacrosse head is usually molded from polymers, such as DuPont Xytel brand nylon. The lacrosse head has an open, or upper, side for catching and discharging a ball and a lower side to which a net or pocket is attached for holding the ball. A lacrosse head has a throat section that includes a ball stop for impacting a ball and a socket for receiving the handle. A pair of sidewalls is attached to the throat section proximate the ball stop and are joined distal from the throat section by a lip or scoop.

In the game of lacrosse, the head is used to catch the ball, hold the ball, and pass or shoot the ball. To this end, there have been several attempts to improve the lacrosse head to enhance the playing of lacrosse.

For example, U.S. Pat. Nos. 4,037,841, 4,270,756, and 6,561,932 disclose the use of cushioning materials placed on the internal surfaces of a lacrosse frame near its base at the ball stop. These cushioning materials are positioned and designed to cushion the impact between the ball and the frame of the lacrosse head once the ball has already been collect, or positioned, within the lacrosse head near the ball stop. These prior art lacrosse heads fail to use cushioning material to absorb energy from an impact between the ball and the pocket of the lacrosse head. As such, the ball has a tendency to rebound or "pop" out of the lacrosse head, which is an unwarranted event during the course of a lacrosse game.

Also, prior art attempts have been made to reconfigure the sidewalls and the ball stop area to improve the performance of a lacrosse head. For examples U.S. Pat. Nos. 5,935,026 and 5,651,549 issued to Dill et al disclose a lacrosse head in which the majority of the head, all the head except for the portion of the head proximal to the throat, lies on a plane below the stick. Additionally, U.S. Pat. No. 5,568,925 discloses an upper wall and a lower wall in which both the upper wall and lower wall curve away from the plane, have a curved base, and then curve back toward the plane.

These patents fail to recognize the need for a flat section separating the divergent and convergent sections near the throat and scope sections of the lacrosse head. Further, the design of the lacrosse head disclosed in U.S. Pat. No. 5,568,925 substantially increases the travel time of a ball through the curvature and reduces the control of the ball during this travel. Also, this curve causes the pocket to be formed further from the scoop. As such, a shot taken with this prior art head is slower and less controlled, which reduces the performance and usefulness of the prior art head during the lacrosse game.

What is needed, then, is a lacrosse head that reduces the energy of impact between the ball and the pocket of the lacrosse head. Preferably, this needed lacrosse head will reduce the rate of deflection of the pocket with respect to the frame upon impact of a ball with the lacrosse head. Additionally, a lacrosse head is needed to properly position the base of the lacrosse head with respect to the scoop and throat of the lacrosse head. This improved design should preferably increase the shot speed and control of a ball traveling from this new lacrosse head. Preferably this lacrosse head carries the lacrosse ball in a position within the lacrosse head that increases the shot speed and accuracy of the shot of leaving the lacrosse head. This needed lacrosse head is presently lacking in the art.

BRIEF SUMMARY OF THE INVENTION

A lacrosse head comprising a frame, a pocket attached to the frame, and at least one energy absorbing element engaging the frame to absorb energy from an impact to the pocket. Preferably, the frame, which includes a scoop, a throat, and sidewalls, includes energy absorbing elements positioned proximate to the throat and along the sidewalls of the frame. The energy absorbing elements can be positioned on an external surface of the perimeter of the frame.

The frame includes pocket attachment apertures and the energy absorbing elements include apertures, wherein the apertures on the energy absorbing elements are substantially aligned with the pocket attachment apertures to secure the energy absorbing elements to the frame.

Also included is a plurality of securing elements shaped to substantially correspond with the shape of the energy absorbing elements. Each energy absorbing element is positioned between one of the securing elements and the frame such that the securing elements can be pressed against the energy absorbing elements and secure the energy absorbing elements in position on the frame. The energy absorbing elements and the securing elements are shaped to substantially conform to the shape of the frame.

The pocket of the lacrosse head includes connection components operatively engaging the energy absorbing elements and the frame. The connection components interact with the energy absorbing elements and the frame such that the energy absorbing elements decelerate deflection, or reduce the rate of movement, of the connection components with respect to the frame. As such, the decelerated deflection of the connection components in turn decelerates the overall deflection of the pocket with respect to the frame. This reduce rate can be accomplished through the resistive nature of the energy absorbing elements.

The energy absorbing elements can be elastic in nature such that they return to their initial, or former, state after deformation. As such, the elastic nature of the energy absorbing elements slows the movement of the connection components and pocket. Energy that would normally go to the deformation of the pocket is used to compress the energy absorbing elements.

The energy absorbing elements should have a greater elasticity and tendency for deformation than the materials that comprises the connection components and pocket. As such, the energy absorbing elements should compress, deflect, and be deformed before any such corresponding compression, deflection, or deformation of the pocket and/or connection components.

In contrast, traditional lacrosse heads have the laces tied directly to the frame. Also, normally the frame is made of a less flexible material than the pockets. As such, in traditional lacrosse heads the pocket will deform to its limit of elasticity and rebound or tend to flex back to its normal shape, thereby having a tendency to force the ball out of the lacrosse head. An inventive feature of the current invention will absorb the energy that normally deflects the pocket and greatly reduce the deflection of the pocket. As such, the rebound effect of the pocket is greatly reduced and the current inventive lacrosse head facilitates the ball staying within the lacrosse head.

Also included is an energy dampening system for use with a lacrosse head having a frame. The energy dampening system includes at least one energy dampening element positioned on the frame to dampen energy from an impact to the frame. The at least one energy dampening element includes a length and a plurality of apertures spaced along the length for attachment to the frame. The energy dampening system further includes at least one securement element shaped to substantially correspond with the shape of the energy dampening element. The securing element includes a length and a plurality of apertures spaced along the length for attachment to the frame. Additionally, the energy dampening element is positioned between the securing element and the frame such that the securement element operatively attaches the energy dampening element to the frame. Preferably, the energy dampening system includes first, second, and third energy dampening elements positioned on the frame between first, second, and third securement elements. Alternatively stated, the first, second and third securement elements engage the first, second, and third energy dampening elements opposite the frame.

Also included is a lacrosse head comprising first and second sidewalls, with each sidewall including a throat end, scoop end, and a middle section. A throat is attached to each throat end, a scoop is attached to each scoop end, and a flat bottom is positioned proximate the throat. Additionally, each throat end and scoop end is positioned further from the flat bottom than the middle section.

Also included is a lacrosse head comprising first and second sidewalls having a throat end, a scoop end, middle section, and a top. A throat is attached to each throat end, a scoop is attached to each scoop end, and a bottom is positioned in a bottom plane. The bottom includes a bottom length and is flat proximate to the throat and substantially flat over the length. Additionally, the top of each sidewall at both the throat end and the scoop end is spaced further from the bottom plane than the middle section is spaced from the bottom plane. Additionally, webbing is included that has a webbing underside positioned to be less than approximately two inches from the top of each sidewall.

Also included is a method of absorbing energy in a lacrosse head having a pocket attached to a frame. The method comprises reducing the rate of movement of a pocket with respect to the frame at points of attachment between a pocket and the frame.

It is therefore a general object of the present invention to absorb the energy of impact between a ball and a lacrosse head.

It is another object of the present invention to absorb the energy of an impact between a ball and a pocket of a lacrosse head.

Still another object of the present invention is to position cushioning elements on a lacrosse head that reduce the rate of movement of a pocket with respect to the frame of a lacrosse head.

Still yet another object of the present invention is to provide a lacrosse head having a substantially flat base.

Yet still another object of the present invention is to provide a lacrosse head designed to position a central holding location of a ball during the carrying of a ball within a lacrosse head closer to the scoop of the lacrosse head.

Another object of the present invention is to provide a lacrosse head having a throat area and scoop area that are substantially positioned in a plane above a base of the lacrosse head.

Other and further objects, features and advantages of the present invention will be readily apparent to those skilled in the art upon reading of the following disclosure when taken in conjunction with the accompanying drawings.

BRIEF DESCRIPTION OF THE SEVERAL VIEWS OF THE DRAWINGS

FIG. 6 shows an example of a pocket attached to the lacrosse head.

FIG. 8 shows an example of a pocket attached to the lacrosse head.

FIG. 10 shows the interaction of the energy absorbing element, securement cover, frame, and pocket during an impact of a ball to the pocket and the absorption of the energy therein by an energy absorbing element.

DETAILED DESCRIPTION OF THE INVENTION

Figure 1:
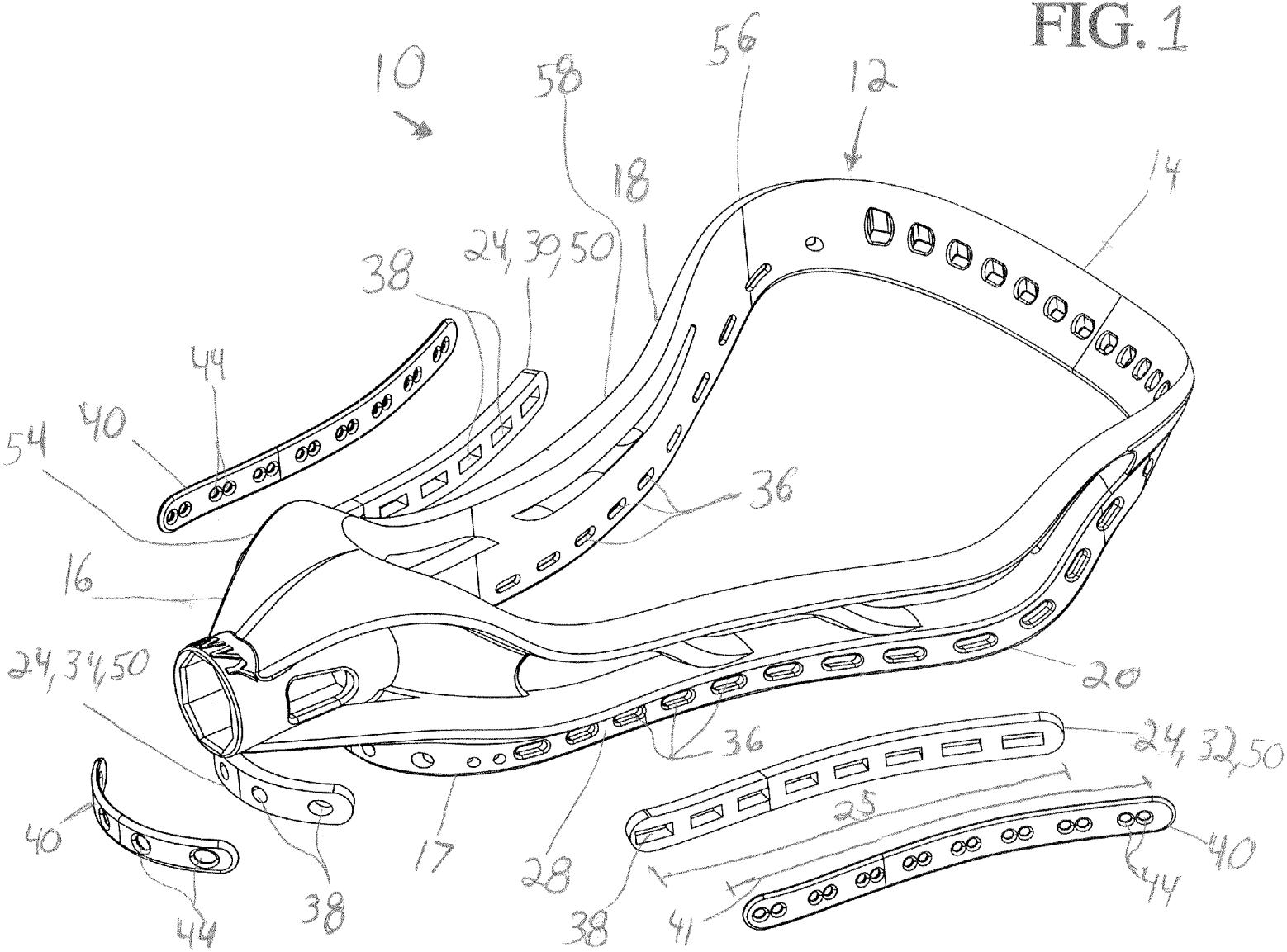
FIG. 1 is an expanded perspective view of an embodiment of a lacrosse head made in accordance with the current disclosure.
Figure 2:
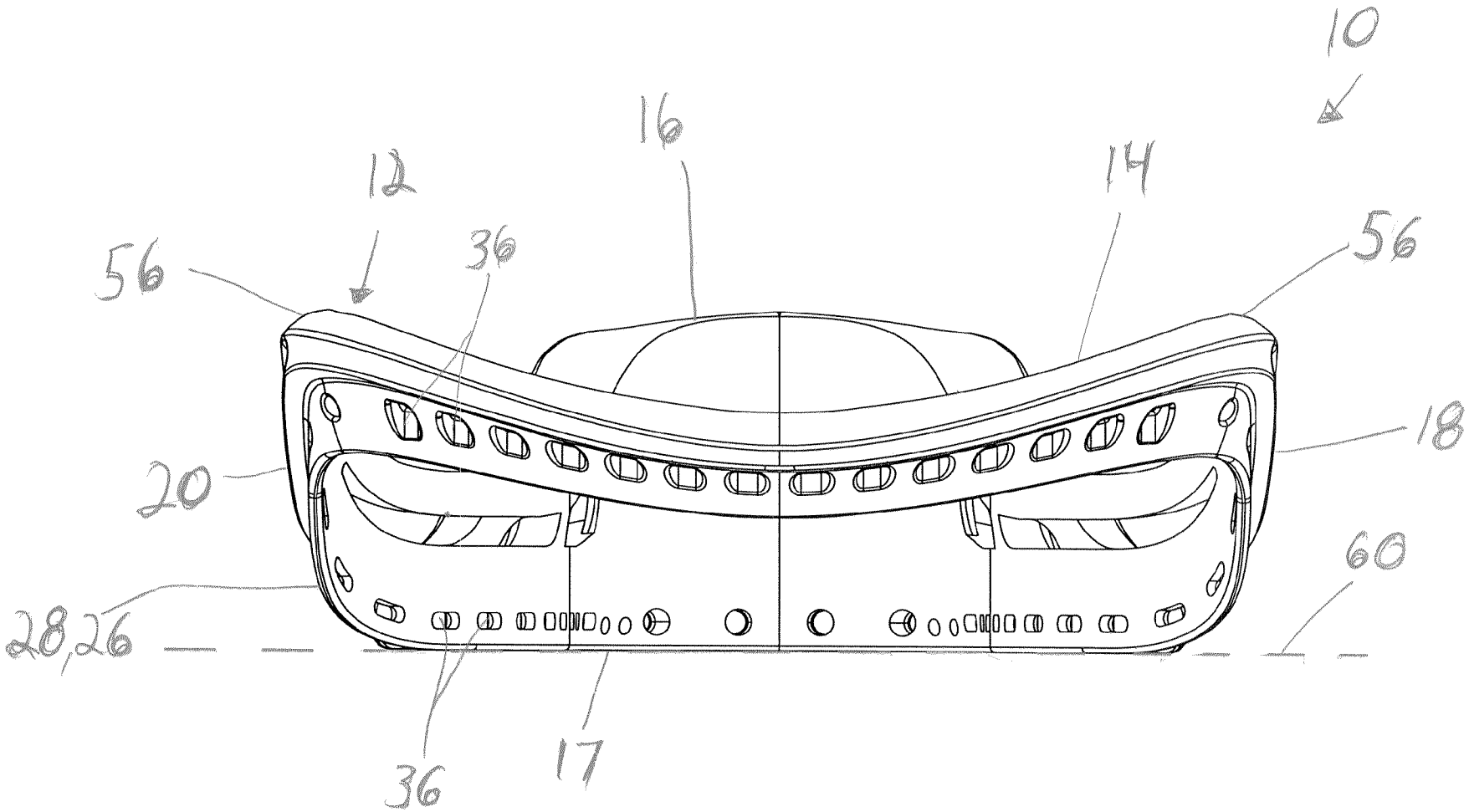
FIG. 2 is a front view of an embodiment of a lacrosse head made in accordance with the current disclosure.
Figure 3:
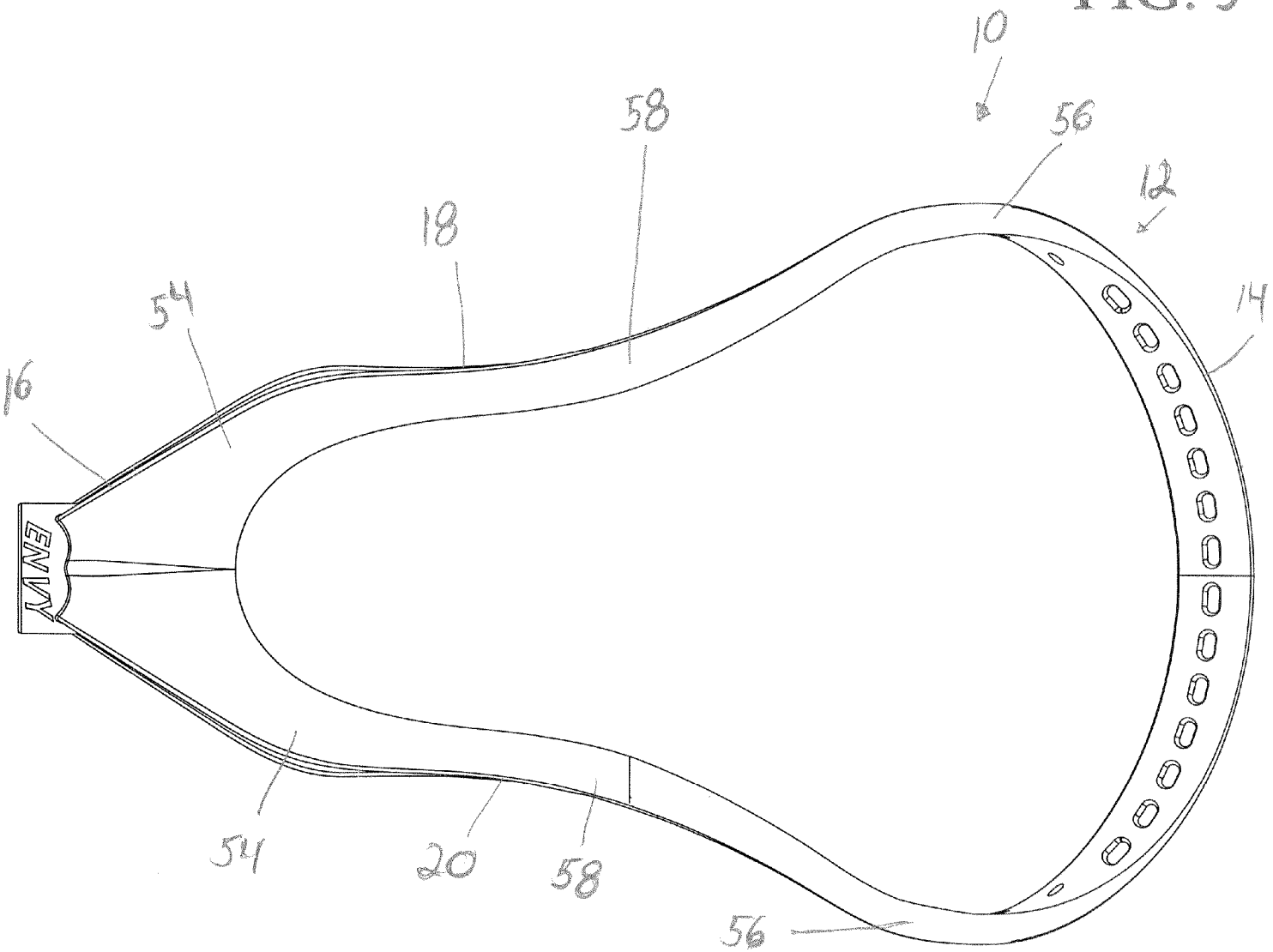
FIG. 3 is a top view of a lacrosse head made in accordance with the current disclosure.
Figure 4:
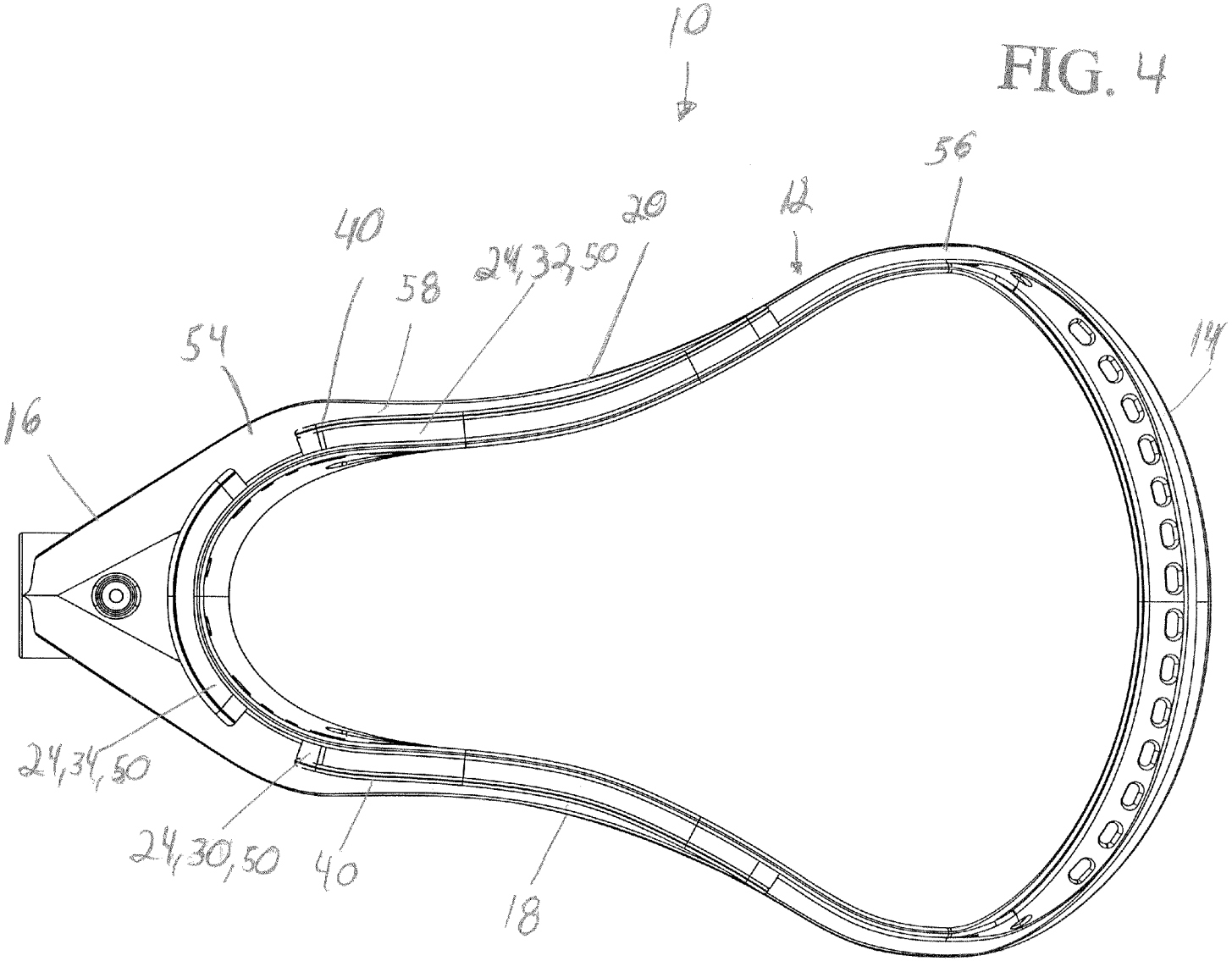
FIG. 4 is a bottom view of a lacrosse head made in accordance with the current disclosure.
Figure 5:
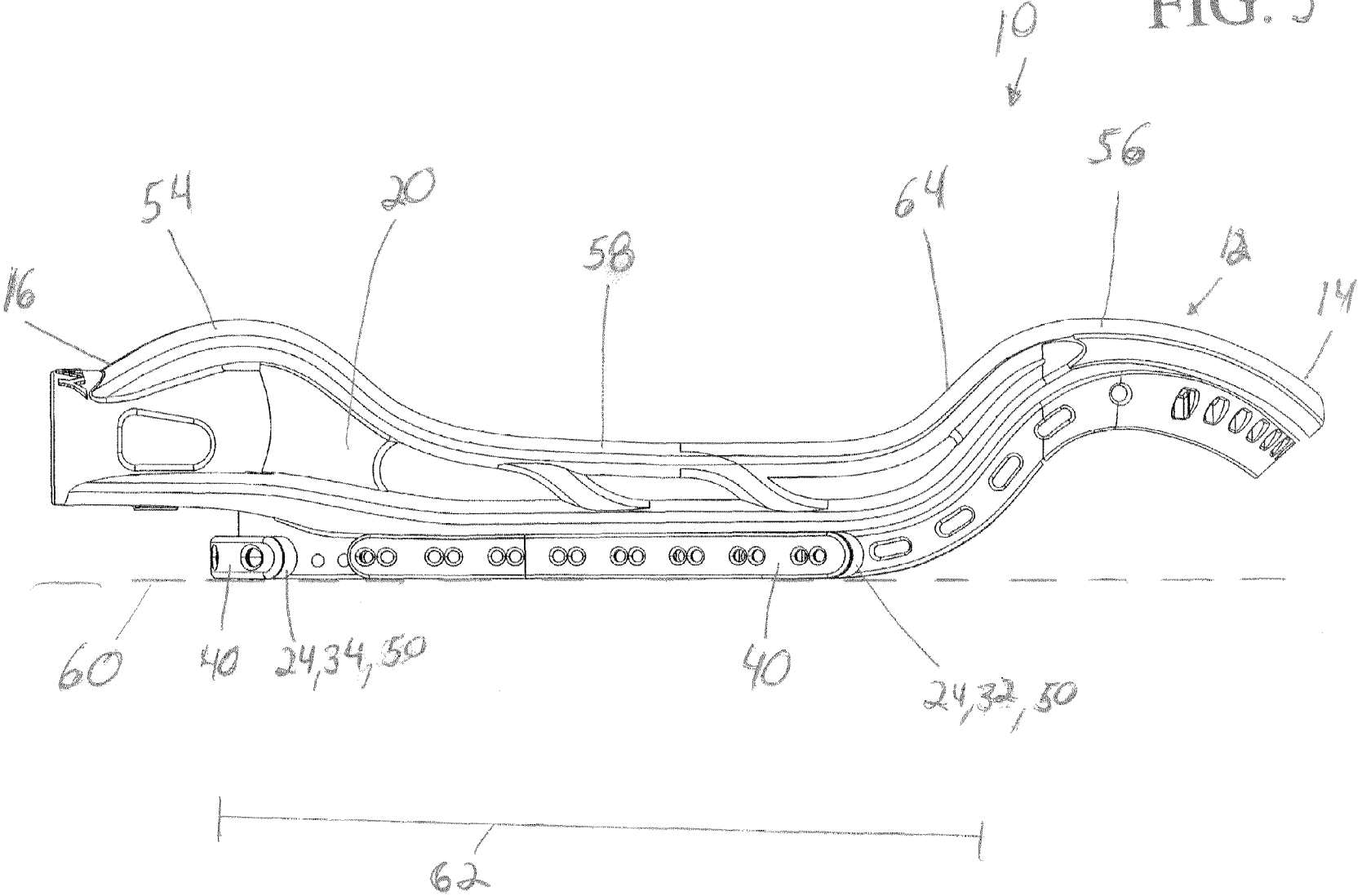
FIG. 5 is a side view of a lacrosse head made in accordance with the current disclosure.
Figure 6:
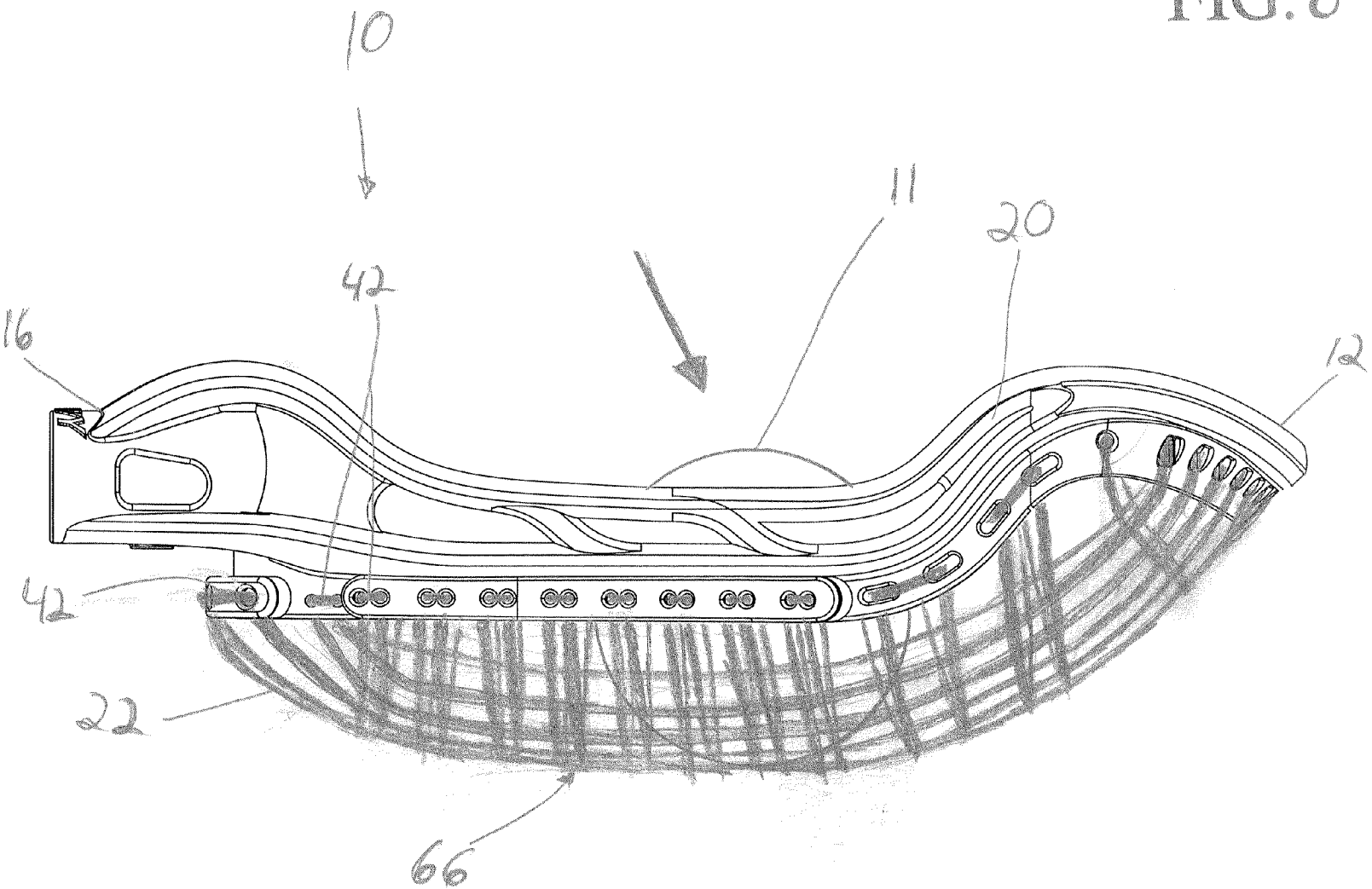
FIG. 6 is a side view similar to FIG. 5.
Figure 7:
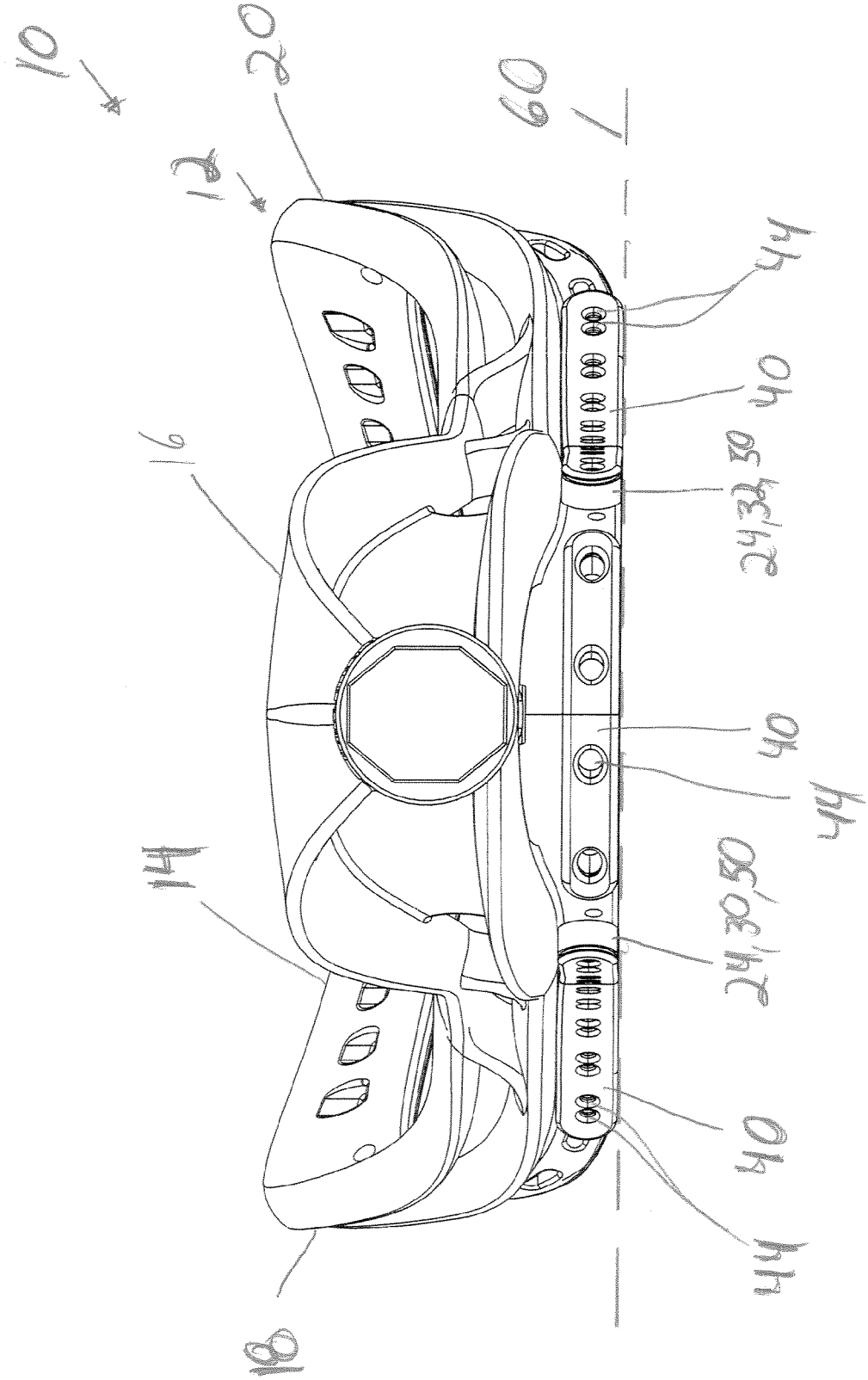
FIG. 7 is a back view of a lacrosse head made in accordance with the current disclosure.
Figure 8:
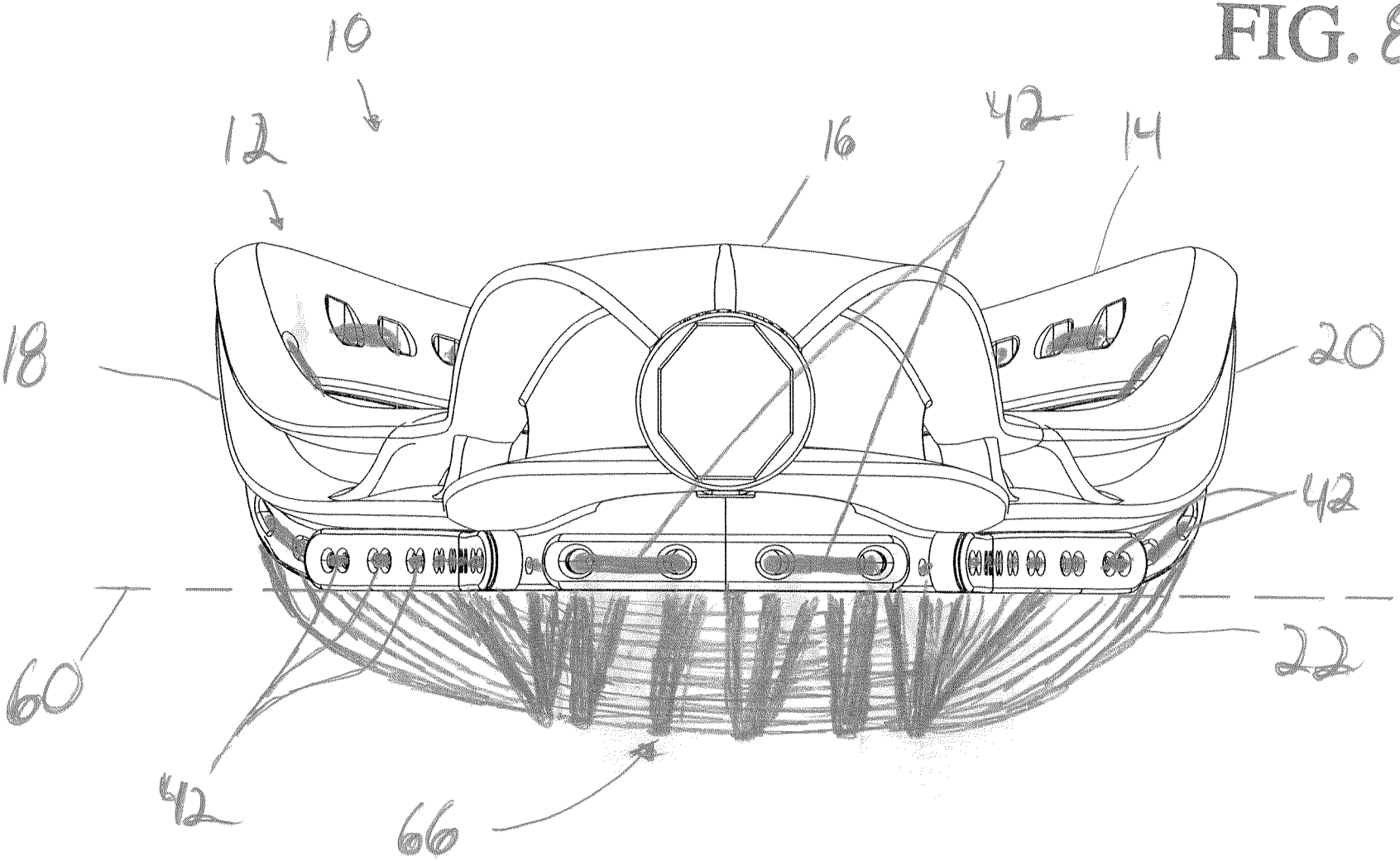
FIG. 8 is a back view similar to FIG. 7.

Referring generally now to FIGS. 1-10 of a lacrosse head is shown and generally designated by the numeral 10. The lacrosse head (10) includes a frame (12) having a scoop (14), a throat (16), and sidewalls (18 and 20). The lacrosse head (10) also includes a pocket (22), which can be described as webbing (22) or a net (22), attached to the frame (12). Additionally, at least one energy absorbing element (24) engages the frame (12) to absorb energy from an impact to the pocket (22).

The lacrosse head (10) is used with a lacrosse ball (11). As such the energy absorbing elements (24) can be described as absorbing energy from an impact between the ball and the pocket (22).

In a preferred embodiment, the frame (12) includes a perimeter (26) and an external surface (28) on the perimeter (26). The energy absorbing element (24) is positioned on the external surface (28) of the perimeter (26).

A first energy absorbing element (30) is positioned on a sidewall (18), a second energy absorbing element (32) is positioned on the sidewall (20), and a third energy absorbing element (34) is positioned proximate to the throat (16). The first, second and third energy absorbing elements (30, 32 and 34) can be described as being positioned along the base (17) of the lacrosse head (10).

The frame (12) includes pocket attachment apertures (36) and the energy absorbing element (24) includes apertures (38) substantially aligned with the pocket attachment apertures (36) for securing the energy absorbing element (34) to the frame (12).

Also included is a cover (40) which can also be described as a securement element (40) shaped to substantially correspond with the shape of the energy absorbing element (24). The cover (40) is positioned to engage and secure the energy engaging element (24) to the frame (12). As such, the energy absorbing element (24) is positioned between the cover (40) and the frame (12). Additionally, the energy absorbing element (24) and the cover (40) are shaped to substantially conform to the shape of the frame (12).

The pocket (22) further includes connection components (42), which can be described as ties, strings, or laces, for connecting the pocket to the frame (12). The connection components (42) operatively engage the energy absorbing elements (24) or the frame (12), which can best be seen in FIGS. 6, 8, 9, and 10. The connection components (42) engage and align the cover (40), energy absorbing elements (24), and frame such that the energy absorbing elements (24) decelerate deflection of the connection components (40) with respect to the frame (12). As such, the energy absorbing elements (40) decelerate deflection of the pocket (22) with respect to the frame (12).

As best seen in FIGS. 6, 8, 9, and 10, the laces (42) of the pocket (22) pass through the pocket attachment apertures (36) of the frame (12), through the apertures (38) of the energy absorbing elements (24), and through the openings (44) of the securement elements (40). Then the laces (42) continue through an adjacent opening (44) in the securement element (40) through an adjacent aperture (38) of the energy absorbing element (24) and back through an adjacent pocket attachment aperture (36) of the frame (12) to continue its path in the composition of the overall pocket scheme. In essence, the laces (42) are looped through the frame (12) and the energy absorbing element (42) and around the securement element (40).

Figure 9:
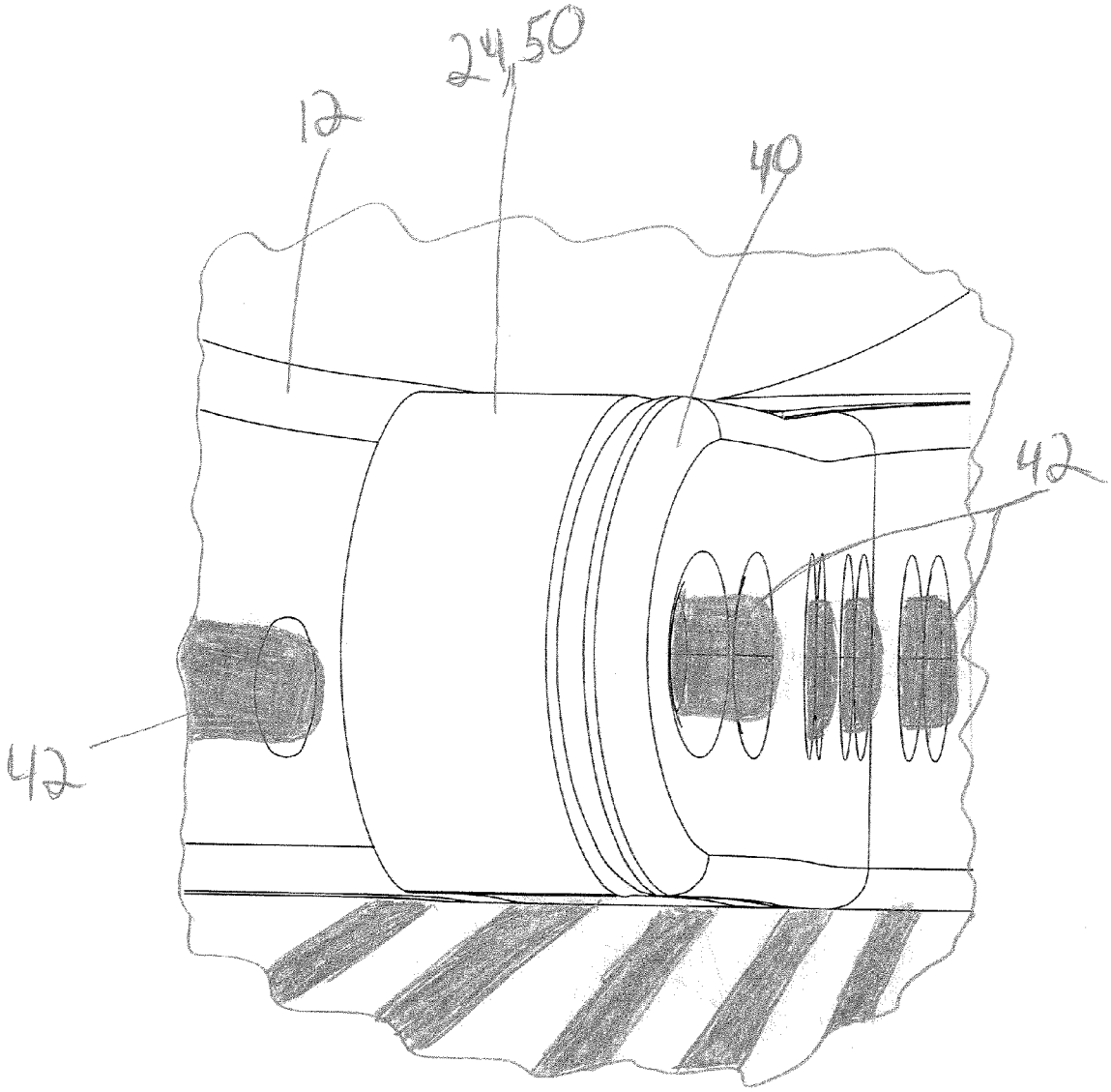
FIG. 9 shows a detailed view of the positioning of an energy absorbing element and a securement cover on a frame prior to impact of a ball with the pocket.
Figure 10:
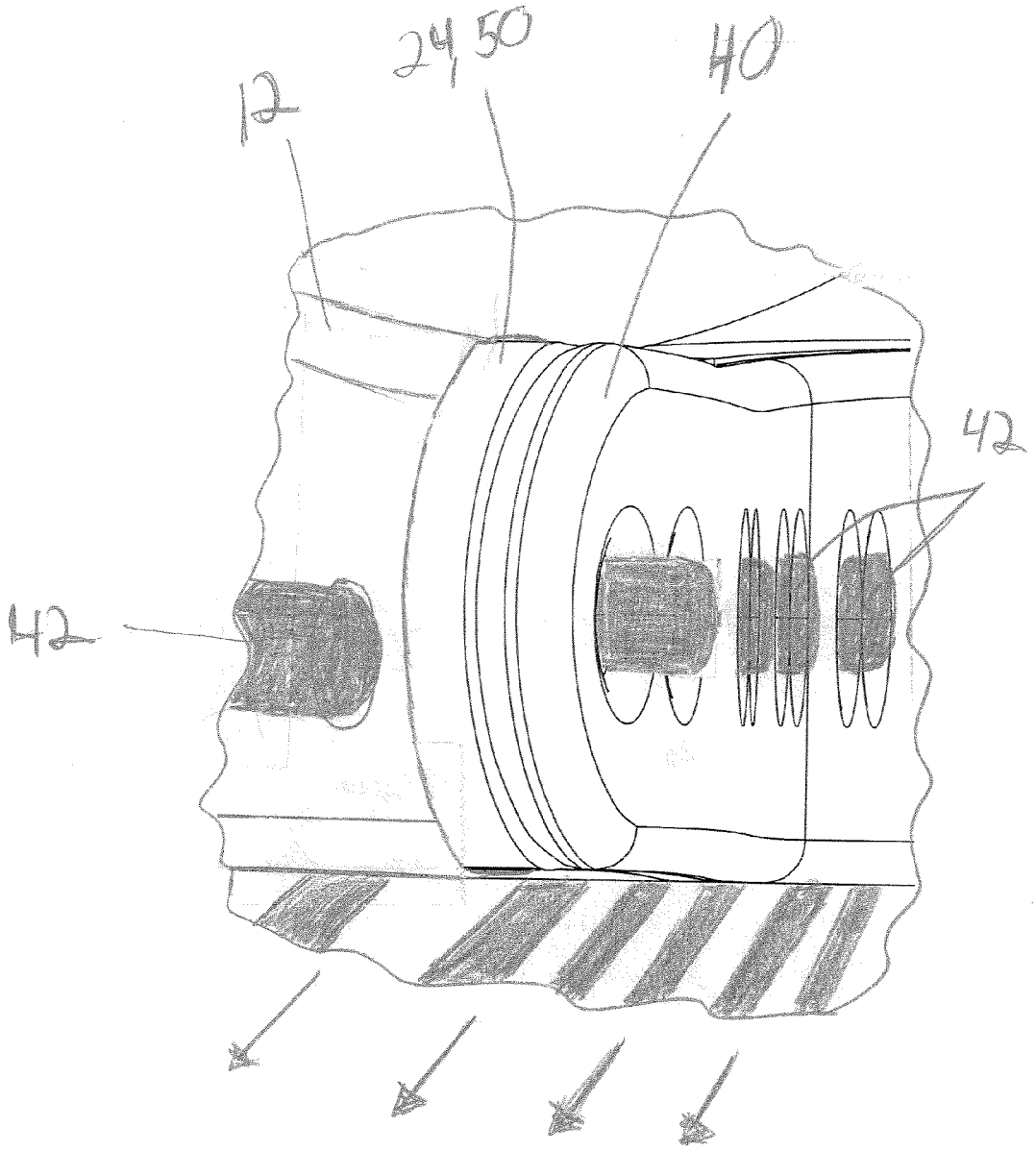
FIG. 10 is similar to FIG. 9.

As such, when a force is applied inwardly on the laces (42), the laces will pull on the cover (40). The cover (40) will in turn deflect the energy absorbing elements (24) to dissipate energy from the force. Energy from am impact to the pocket (22) is absorbed by the energy absorbing elements (24) by the compression of the energy absorbing element (24) between the cover (40) and the frame (12). This can best be seen in FIGS. 9 and 10. In FIG. 9, an energy absorbing element is seen prior to impact of a ball (11) to the pocket (22). FIG. 10 shows the compression of the energy absorbing element (24) as forces are being applied to the pocket to pull the laces (42) towards the interior of the frame (12).

Additionally, the securement element (40) is comprised of a harder material than the energy dampening element (24). In a preferred embodiment the energy dampening element (24) is comprised of foam, such as open cell urethane or vinyl nitrile. The securing element (40) is comprised of nylon, such as DuPont Xytel brand nylon.

The energy absorbing elements (24) reduce the rate of movement of the connection components (42). Preferably this reduce is accomplished through the resistive nature of the energy absorbing elements (24). The energy absorbing elements (24) are elastic in nature and return to their initial, or former, state after deformation. The energy absorbing elements (24) preferably compress at a rate faster than they return back to their original shape. The rate of return to the original state is slower than the rate of deformation to reduce a possible trampoline effect in the pocket (22). If unchecked, the trampoline effect of the pocket tends to force a lacrosse ball out of the lacrosse head.

As such, the movement of the connection components (42) and pocket (24) is slowed due to the elastic nature of the energy absorbing elements (24). Energy that would normally go to the deformation of the pocket (22) is used to compress the energy absorbing elements (24). Ideally, the energy absorbing elements (24) have a greater elasticity and tendency for deformation than the material that comprises the connection components (42) and pocket (22). As such, the energy absorbing elements (24) will compress, deflect, and be deformed before any such corresponding compression, deflection, or deformation of the pocket (22) and/or connection components (42).

Also included is an energy dampening system (50) for use with a lacrosse head (10) having a frame (12). The energy dampening system (50) comprises at least one energy dampening element (24) positioned on the frame (12) to dampen energy from impact to the frame (12). The energy dampening element (24) includes a length (25) and a plurality of apertures (38) spaced along the length (25) for attachment to the frame (12). The energy dampening system (50) further includes at least one securement element (40) shaped to substantially correspond with the shape of the energy dampening element (24). The securement element (40) includes a length (41) and a plurality of openings (44) spaced along the length (41) for attachment to the frame (12). Preferably, the at least one energy dampening element (24) is positioned between the securement element (40) and the frame (12).

Also disclosed is a lacrosse head comprising first and second sidewalls (20) with each sidewall (20) including a throat end (54), a scoop end (56) and a middle section (58). A throat (16) is attached to each throat end (54), while a scoop (14) is attached to each scoop end (56). A bottom (17) is positioned proximate to the throat (16) wherein the bottom (17) is flat. Additionally, each throat end (54) and scoop end (56) is positioned farther from the flat bottom (17) than the middle section (58) is positioned from the flat bottom (17).

The bottom (17) can be described as positioned in a bottom plane (60) and having a bottom length (62), wherein the bottom (17) is flat proximate to the throat (16) and substantially flat over the length (62). Additionally, the top (64) of each sidewall (20) at the throat end (54) and the scoop end (56) is spaced further from the bottom plane (60) than the top (64) of the middle section (58) is spaced from the bottom plane (60). This shape of the lacrosse head having the flat bottom (17) and the raised throat end (54) and scoop end (56) facilitates an increase in shot speed and shot control of a ball (11) from the lacrosse head (10).

Additionally, the lacrosse head (10) includes a webbing (22) having a webbing underside (66) positioned to be less than approximately two inches from the top (64) of each side wall (20).

Thus, although there have been described particular embodiments of the present invention of a new and useful Lacrosse Head With Cushioned Sidewalls, it is not intended that such references be construed as limitations upon the scope of this invention except as set forth in the following claims.

What is claimed is:

1. A lacrosse head for use with a lacrosse ball comprising:

a frame having a throat, a scoop, and sidewalls;

a pocket connected to the frame by a plurality of connection components, the connection components extending through the frame; and at least one detachable energy absorbing element operatively engaging the frame and the connection components to absorb energy from an impact between the ball and the pocket, the at least one energy absorbing element positioned between at least one of the connection components and the a portion of the frame, wherein said portion of the frame engaging the at least one energy absorbing element is positioned between the at least one energy absorbing element and the pocket and further including a cover shaped to substantially correspond with the shape of the at least one energy absorbing element, the at least one energy absorbing element positioned between the cover and the frame.

2. The lacrosse head of claim 1, the frame further including a perimeter and the at least one energy absorbing element is positioned on the perimeter.

3. The lacrosse head of claim 2, the perimeter further including an external surface and the at least one energy absorbing element is positioned on the external surface.

4. The lacrosse head of claim 1, wherein first and second energy absorbing elements are positioned on the sidewalls.

5. The lacrosse head of claim 4, further including a third energy absorbing element positioned proximate the throat.

6. The lacrosse head of claim 1, wherein:

the frame includes pocket attachment apertures; and the at least one energy absorbing element includes apertures substantially aligned with the pocket attachment apertures for securing the at least one energy absorbing element to the frame.

7. The lacrosse head of claim 1, wherein the at least one energy absorbing element has a compression rate and return rate, the compression rate is faster than the return rate.

8. A lacrosse head used with a lacrosse ball comprising:

a frame including a scoop, a throat, and sidewalls;

a pocket attached to the frame by a plurality of connection components, the pocket secured to the frame and shaped to catch the ball, the connection components extending through the frame;

a plurality of energy absorbing elements operatively engaging the frame and the connection components to absorb energy from an impact between the ball and the pocket; and further including a cover shaped to substantially correspond with the shape of the at least one energy absorbing element, the at least one energy absorbing element positioned between the cover and the frame and a plurality of securement elements wherein each energy absorbing element is positioned between one of the securement elements and the frame, wherein at least one of the securement elements compresses at least one of the energy absorbing elements upon impact of the ball and the pocket and movement of the pocket relative to the frame.

9. The lacrosse head of claim 8, wherein:

first and second energy absorbing elements are positioned on the sidewalls; and a third energy absorbing element is positioned proximate the throat.

10. The lacrosse head of claim 8, wherein:

the frame includes pocket attachment apertures; and the at least one an energy absorbing element includes apertures substantially aligned with the pocket attachment apertures for securing the at least one an energy absorbing element to the frame.

11. The lacrosse head of claim 8, wherein at least one of the plurality of securement elements is shaped to substantially correspond with the shape of at least one of the plurality of energy absorbing elements.

12. The lacrosse head of claim 8, the pocket further including connection components operative engaging the energy absorbing elements and the frame, wherein the energy absorbing elements decelerate deflection of the connection components with respect to the frame.

13. An energy damping system for use with a lacrosse head including a frame having a plurality of frame apertures and a pocket engaging the plurality of frame apertures through a plurality of connection components, the energy damping system comprising:

at least one energy damping element operatively engaging the frame to dampen energy from an impact to the frame, the at least one energy damping element including a length and a plurality of damping apertures spaced along the length of the energy damping element, the plurality of damping apertures positioned to accept the plurality of connection components, the at least one energy damping element positioned to space the plurality of connection components from the frame;

at least one securement element shaped to substantially correspond with the shape of the at least one energy damping element, the at least one securement element including a length and a plurality of openings spaced along the length for attachment to the frame;

wherein the at least one energy damping element is shaped to be positioned between the at least one securement element and the frame; and wherein the at least one securement element is comprised of harder material than the at least one energy damping element and;

wherein the openings and damping apertures are substantially aligned and shaped to be aligned with the frame apertures and the at least one energy damping element is positioned to restrict movement of the pocket through the frame apertures and be compressed by the at least one securement element.

14. The energy damping system of claim 13, wherein first, second, and third energy damping elements are positioned on the frame and first, second, and third securement elements are engaging the first, second, and third energy damping elements opposite the frame.

* * * * *